US006968795B2

(12) United States Patent
Lambregts et al.

(10) Patent No.: US 6,968,795 B2
(45) Date of Patent: Nov. 29, 2005

(54) VERY LARGE VESSEL CONSTRUCTION

(75) Inventors: Adam F. J. M. Lambregts, Raamsdonksveer (NL); Bram Van Cann, Rotterdam (NL); Sjoerd Maarlen Hendriks, Delft (NL); Leendert Poldervaart, La Turbie (FR)

(73) Assignee: Single Buoy Moorings, Inc., Monaco Cedex (MC)

( * ) Notice: Subject to any disclaimer, the term of this patent is extended or adjusted under 35 U.S.C. 154(b) by 3 days.

(21) Appl. No.: 10/686,171

(22) Filed: Oct. 15, 2003

(65) Prior Publication Data

US 2004/0079268 A1 Apr. 29, 2004

Related U.S. Application Data

(60) Provisional application No. 60/422,255, filed on Oct. 28, 2002.

(51) Int. Cl.[7] ..... B63B 3/00
(52) U.S. Cl. ..... 114/65 R; 114/77 R
(58) Field of Search ..... 114/65 R, 77 A, 114/77 R, 74 R, 356

(56) References Cited

U.S. PATENT DOCUMENTS 3,527,185 A * 9/1970 Yamada et al. ..... 114/77 R
3,859,944 A * 1/1975 Warner ..... 114/74 R
4,341,175 A * 7/1982 Ivanov ..... 114/65 R
5,269,246 A 12/1993 Goldbach et al.
5,577,454 A 11/1996 Goldbach

FOREIGN PATENT DOCUMENTS

| | | | |
|---|---|---|---|
| EP | 0460851 A1 | | 12/1991 |
| EP | 0635424 A1 | | 1/1995 |
| GB | 2331058 A | | 8/1997 |
| JP | 54-122595 | * | 9/1979 |
| JP | 58-78881 | * | 5/1983 |

* cited by examiner

*Primary Examiner*—Ed Swinehart
(74) *Attorney, Agent, or Firm*—Leon D. Rosen

(57) ABSTRACT

A very large hydrocarbon production vessel (10) of at least 40,000 tons steel weight, is constructed without requiring a very long reserve time period in a very large dry dock. The hull of the vessel is constructed in at least three different hull sections, including a midship hull section (24) and bow and stern hull sections (20, 22), with each preferably constructed at a different construction site. The hull sections are then brought together in a very large dry dock and welded together, so a minimum amount of time must be reserved in the very large dry dock. The midship hull section is preferably constructed in a specialized shipyard, and the same shipyard installs drilling equipment (50) and equipment that connects to risers that bring up hydrocarbons, so the expertise of the shipyard is used for both the midsection hull construction and specialized drilling and riser handling equipment.

6 Claims, 3 Drawing Sheets

VERY LARGE VESSEL CONSTRUCTION

CROSS-REFERENCE TO RELATED APPLICATION

Applicant claims priority from U.S. provisional patent application No. 60/422,255 filed Oct. 28, 2002.

BACKGROUND OF THE INVENTION

Shipyards have one or more dry docks with slots of time (continuous periods) reserved for the construction of vessels. The required slot time depends upon the steel production rate of the shipyard, which is the rate at which large steel sections can be welded together. Very large vessels with a hull steel weight of over 40,000 tons require a long period to build. It can require a long time and great difficulty to find sufficiently long slot times available in a dry dock for such large vessels. One prior art method for reducing the time in a dry dock is to fabricate only the vessel hull in the dry dock, and then float out the hull to a location where topside packages (equipment to be mounted on the hull) are installed, as along side a quay or dock. Although this reduces the required time in the dry dock, it does not reduce the time greatly because most of the time required to construct a complete vessel is the time for welding together plates to form the hull. The topside packages are usually pre-fabricated, and can be rapidly lifted into place and connected, provided that heavy duty cranes are available at the dry dock. A system for constructing a very large vessel, and especially a FPDSO complex (including Floating, Production, Drilling, Storage and Offloading Sections) using a minimum amount of time of a very large dry dock, would be of value. It would be even more useful if the different sections of the vessel could be constructed with greater expertise than at present.

SUMMARY OF THE INVENTION

In accordance with one embodiment of the present invention, a method is provided for constructing a very large vessel, and especially a large hydrocarbon production vessel, which requires a minimum reserved slot of time in a very large dry dock. The method includes constructing the ship in at least three different sections, towing at least some of the sections to the very large dry dock, and assembling the sections thereat.

Each of the sections to be towed to the very large dry dock preferably have ends that are watertight to facilitate towing. Topside packages are preferably installed at the fabrication yard that constructs the hull section. This is especially desirable for a midsection hull section which carries drilling equipment and riser connection equipment, so that a specialized fabrication yard can be used for construction of the midship hull section and installation of the equipment on it, to minimize defects and assure very high quality. Oil storage tanks are constructed during hull construction of bow and stern ends, but are not included in the midship hull section, to keep stored oil away from drilling equipment and drilling operations.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
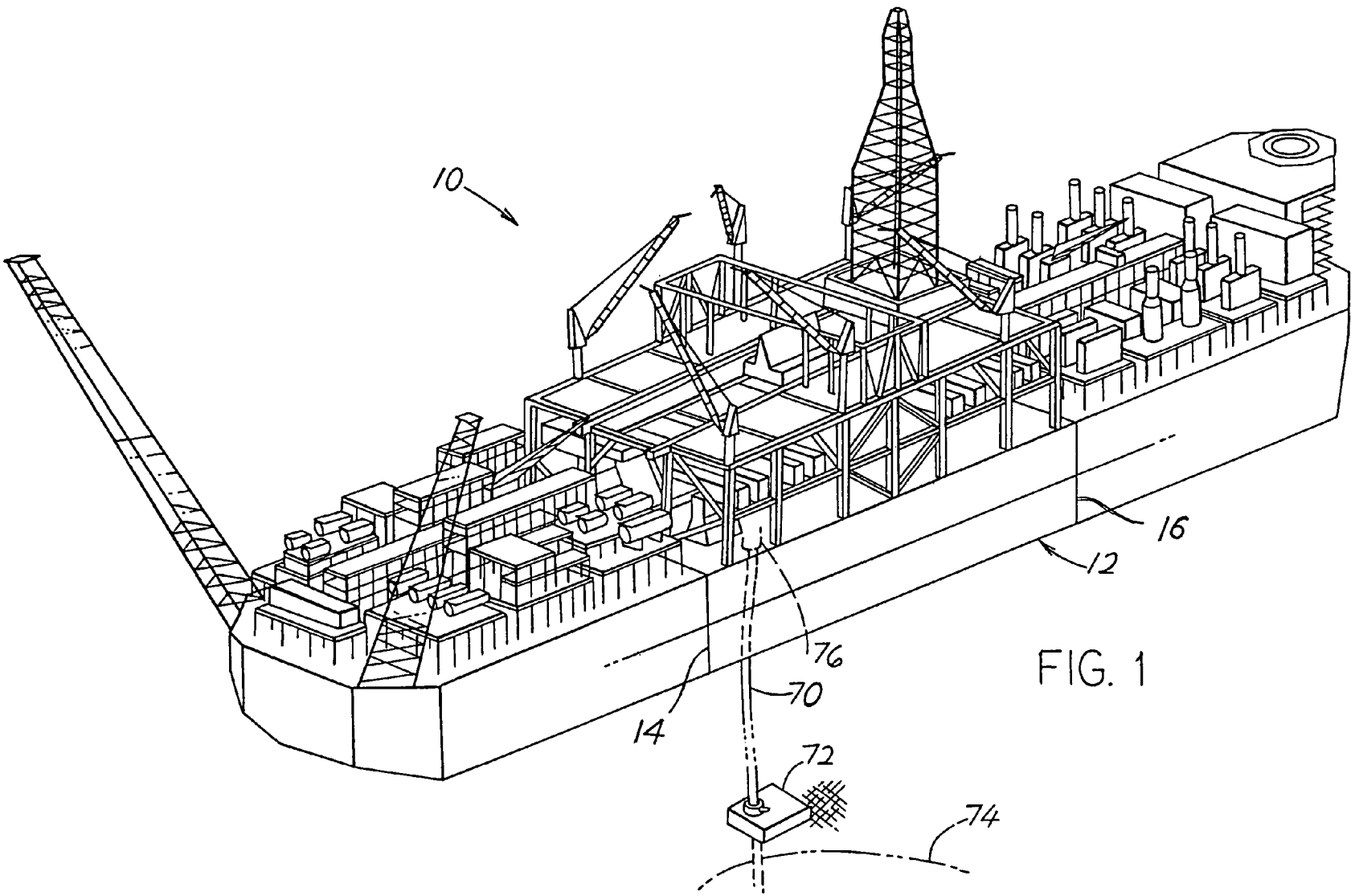
FIG. 1 is a front or bow end isometric view of a very large vessel constructed in accordance with the present invention, and shown coupled to a seafloor hydrocarbon reservoir.

FIG. 1 illustrates a FPDSO complex (Floating, Production, Drilling, Storage and Offloading Sections) or vessel 10 of a type that is designed to be stationed at an offshore oil field, to drill undersea wells and produce hydrocarbons from the wells. The vessel is also constructed to process the hydrocarbons, including separating gas and water from liquid hydrocarbons while reducing the high pressures. The vessel stores the hydrocarbons and offloads stored hydrocarbons to tankers that regularly come to the vicinity of the vessel to carry away the hydrocarbons.

Figure 2:
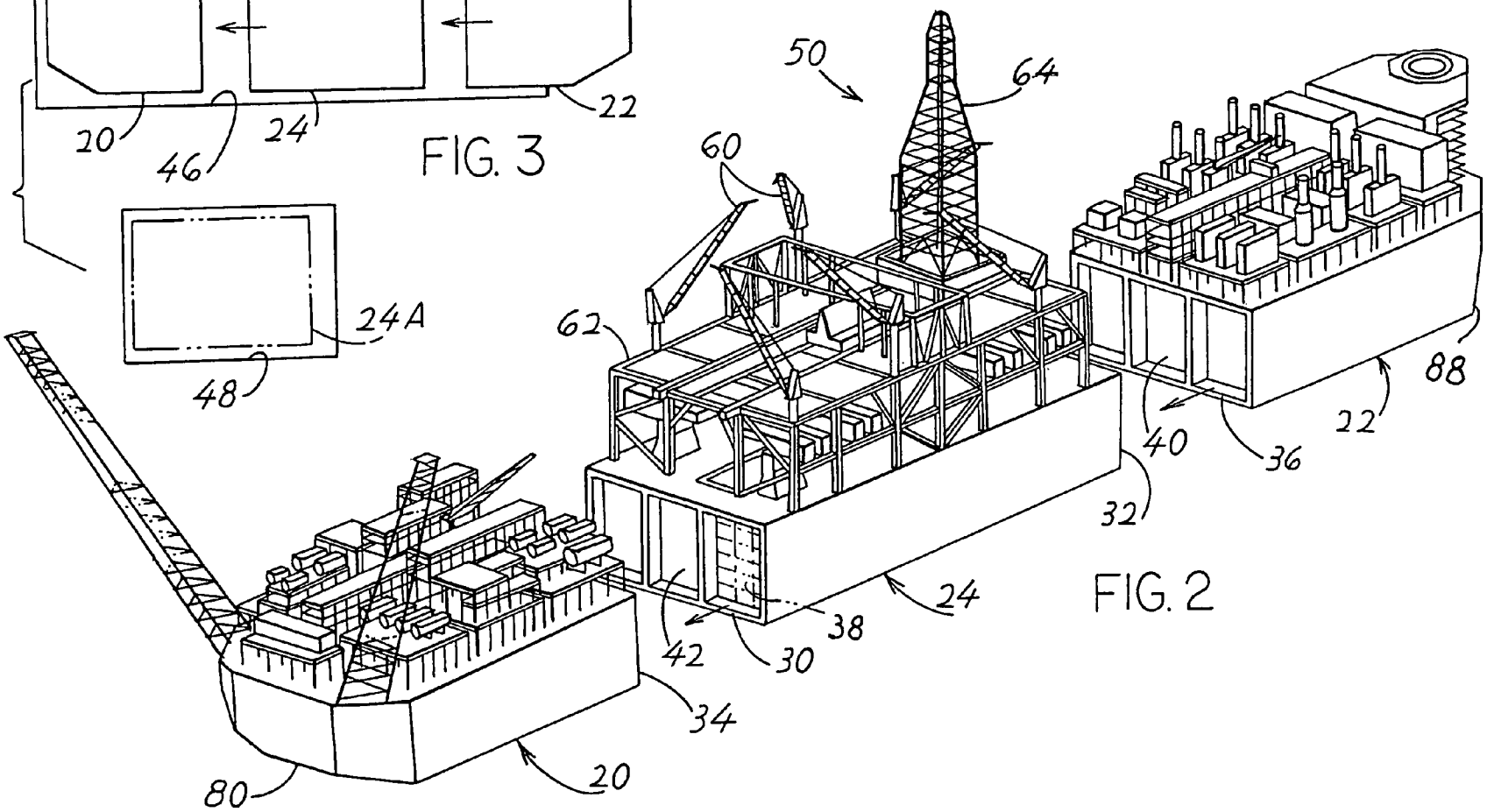
FIG. 2 is a bow end isometric view of three sections of the vessel of FIG. 1, which are to be connected together to make the complete vessel of FIG. 1.

Applicant constructs the FPDSO vessel 10 by constructing the hull 12 in the manner shown in the FIG. 2, so the hull is initially constructed in three separate sections joined at weld lines 14, 16. These three hull sections include a bow hull section 20, a stern hull section 22 and a midship hull section 24. At least the midship hull section 24 is constructed in a different fabrication yard, and usually at a different shipyard from where the bow and stern hull sections are constructed. Such fabrication yards usually, but not always, include a dry dock in which the hull section is built. The bow and stern hull sections preferably, but not necessarily, are constructed in different fabrication yards. This reduces the time slot in a very large dry dock that must be available to construct the corresponding hull section, making it easier to fabricate the large vessel within a moderate period of time. The construction of each hull section occurs after authorization is given, which may occur after financing is achieved and a major contract is agreed to for exploiting an oil field, etc.

Applicant notices that certain shipyards have heightened expertise in constructing certain types of vessels. For example, certain shipyards have expertise in constructing drilling vessels, which may have one or more moonpools through which drill stems may be extended by a derrick, and where risers later may be connected to bring up hydrocarbons from an undersea reservoir. Other shipyards have expertise in building vessels that process hydrocarbons produced from offshore oil fields. By having each hull section, which may serve different purposes, in shipyards that have expertise in that type of construction, applicant obtains higher quality construction. Applicant prefers to construct each hull section 20, 22, 24 so it is seaworthy, to be towed or shipped to an assembly dry dock. The bow and stern ends 30, 32 of the midship hull section 24 are each sealed by steel plates 38 welded across the width and height of the ends of the hull section to make the midship hull section 24 watertight. Similarly, the stern end 34 of the bow hull section 20 and the bow end 36 of the stern hull section are sealed watertight. After at least two of the three hull sections are made seaworthy, they are towed to a very large dry dock where they can be welded together in tandem. It is possible for one of the hull sections, especially section 24, to not be seaworthy and to remain in a large dry dock until the other sections are brought to it. However, this generally would require that a very large dry dock be tied up until that stationary hull section is finished, which is generally not economical.

Figure 3:
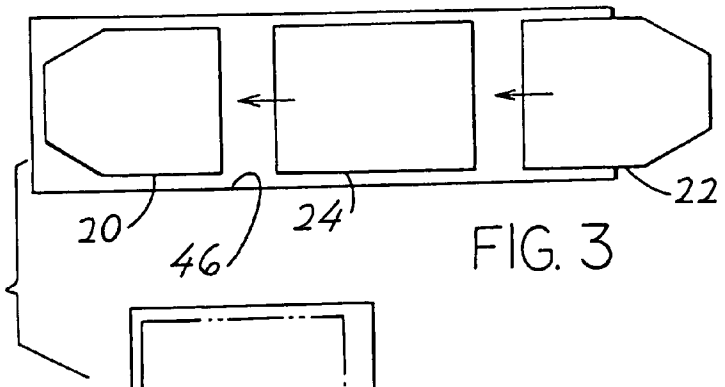
FIG. 3 includes a simplified plan view of a large dry dock into which all three vessel sections of FIG. 2 are being moved for welding them together, and a simplified plan view of a smaller dry dock with the hull midship section shown in phantom lines therein.

When the three hull sections 20, 22, 24 have been transported to a large dry dock which can accommodate the three of them in tandem, their adjacent ends are welded together. That is, the stern end 34 of the bow hull section is welded to the bow end 30 of the midship hull section, and the ends 32, 36 of the other hull sections are welded together. Applicant prefers to construct the hull sections with cofferdams such as shown at 40 and 42 at the hull section ends to be welded together. FIG. 2 shows the cofferdam structures 40, 42 at the bow ends of the stern and midship hull sections 22, 24. Preferably, two additional cofferdam sections, or cofferdams are provided, one at the stern end 32 of the midship hull section and one at the stern end 34 of the bow hull section. FIG. 3 shows the three hull sections 20, 22, 24 moving into a very large dry dock 46 being used as an assembly dry dock, where they will be welded together in tandem. It is possible to determine that the different hull sections were manufactured independently, that is, at different fabrication yards, by carefully inspecting the welds. The presence of cofferdams also show this.

As mentioned, applicant prefers to weld plates across the ends 30, 32 of the midship hull section to permanently seal it. Applicant can weld plates against the ends 34, 36 of the other two hull sections or can provide lower cost temporary sealing against water for the purpose of preventing flooding during towing to the final dry dock. The permanently sealed ends 30, 32 of the midship hull section are provided to keep large quantities of oil away from that section, because the midship hull section 24 is used for drilling which can create high temperatures and sparks. Any significant accumulation of oil in the region would be dangerous. It is possible to have the hull sections 20, 22, 24 not floatable to enable simple towing to a dry dock, but instead apply large floats to them, or put them on a special heavy lift and transportation vessel. However, this increases cost and applicant prefers to make the hull sections floatable without requiring semi-submersible floats for a special vessel to float them.

Most equipment on the vessel is installed in topside packages. The topside packages include a complete drilling equipment set 50 in the midship hull section. The drilling equipment set includes cranes 60 for lifting heavy equipment such as are used in drilling, a drilling derrick support structure 62 for supporting a skiddable drilling derrick 64 and riser tensioning systems for tensioning risers. Risers carry hydrocarbons from the undersea reservoir up to the vessel, and may carry fluids or signals (e.g. reinjection water, valve control signals, etc.) down to the seafloor structure. FIG. 1 shows a riser 70 and a seafloor platform 72, for removing hydrocarbons from an undersea reservoir 74 of an oil field, and a riser coupling 76 on the vessel.

The drilling equipment of the midship hull section 24 shown in FIG. 2, also includes at least one moonpool, an auxiliary deck, and a portal structure that covers the moonpool and that can support the derrick (skiddable or fixed drilling derrick 64). Because of the danger of falling equipment as well as sparks during drilling, applicant stores only water and drilling and connection equipment in the midship hull section 24. This equipment is generally more reliable if installed and tested by a specialized shipyard that specializes in constructing and repairing drilling vessels.

Figure 4:
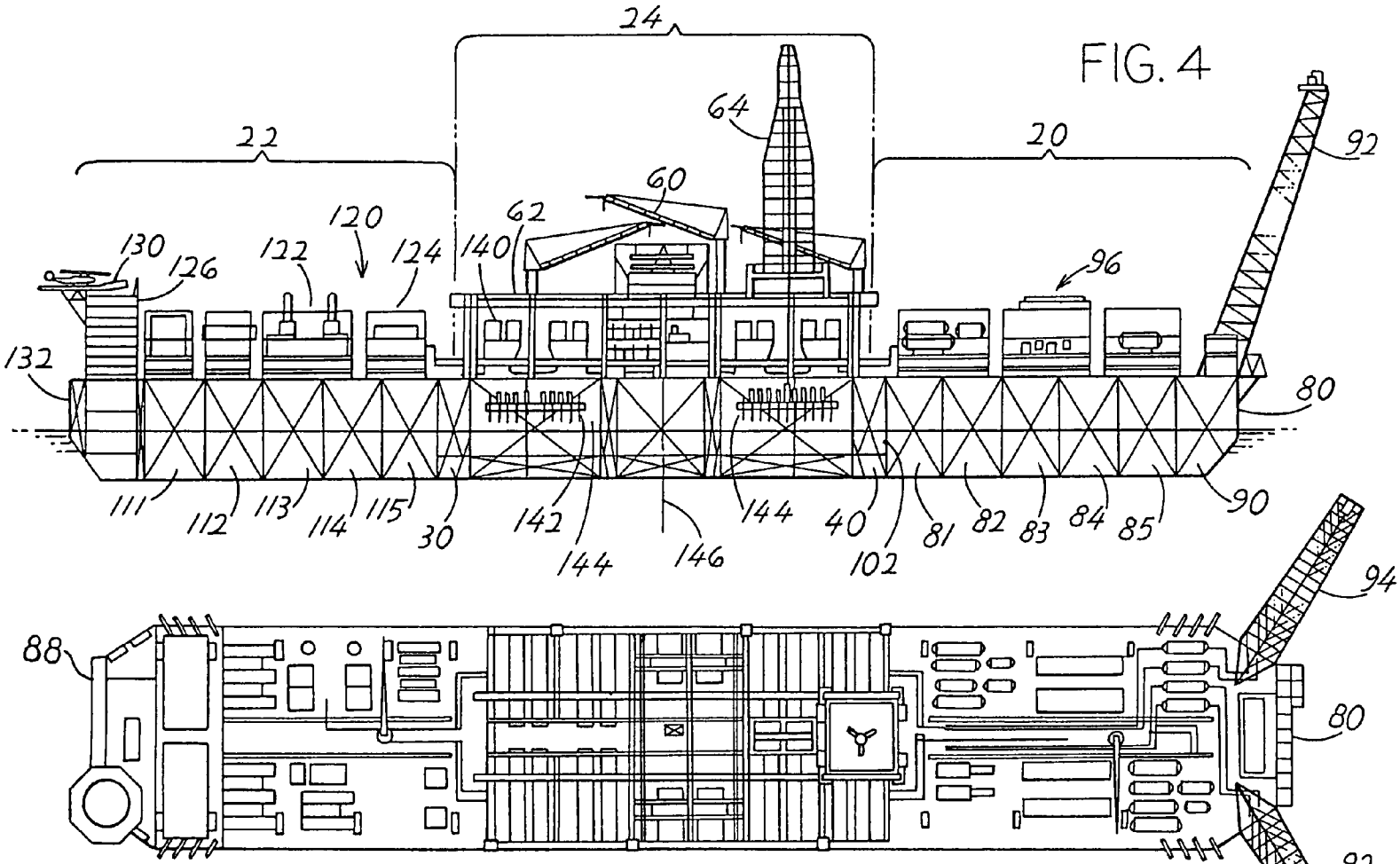
FIG. 4 is a sectional side view of the vessel of FIG. 1.
Figure 5:
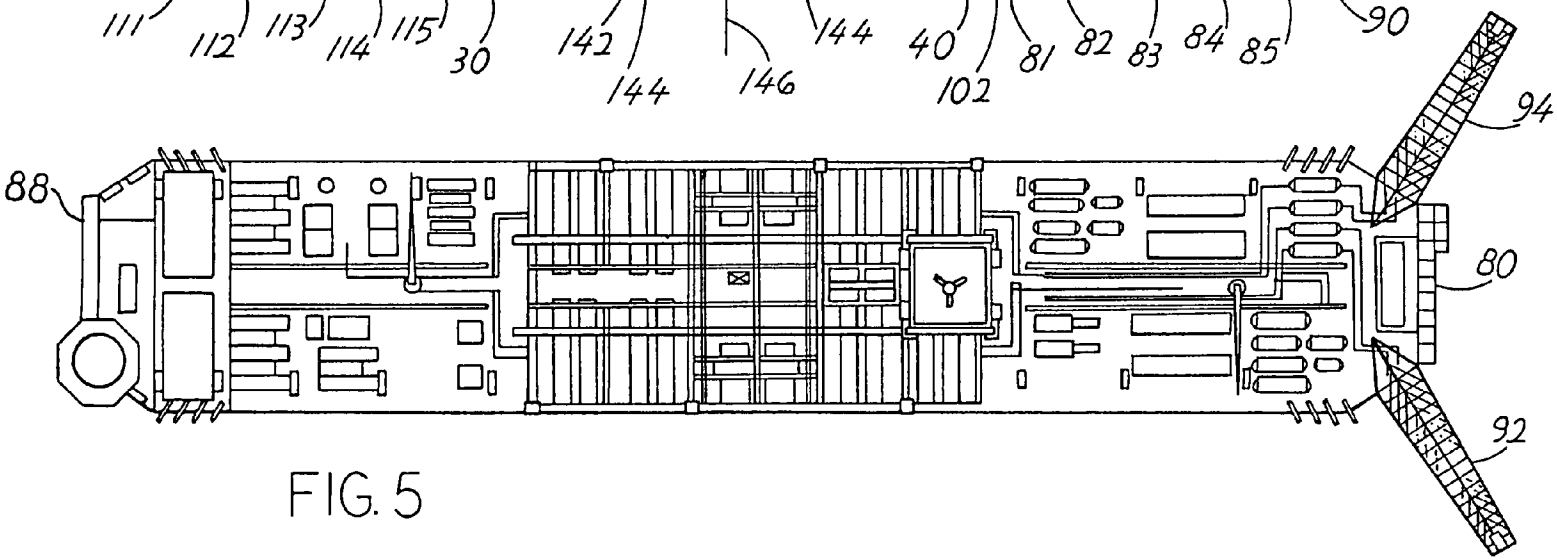
FIG. 5 is a sectional top view of the vessel of FIG. 4.

FIGS. 4 and 5, show the vessel wherein the bow end 80 is to the right rather than the left and the stern end 88 is to the right. These figures show that the bow hull section 20 contains five crude oil (or other hydrocarbon) storage tanks 81–85, each having a capacity of a plurality of cubic meters. A frontmost tank 90 holds water ballast. A pair of flare booms 92, 94 project largely vertically from the front of the bow section. Additional topside modules 96 are mounted on the top of the bow hull section 20. The stern end of the bow section includes a sealing wall 102 that seals the bow end of that section.

The stern hull section 22 includes a plurality of crude oil storage tanks 111–115 that each has a capacity of a plurality of cubic meters. Additional topside modules 120 include a power generating module 122 that generates power, such as in the form of electricity that operates all electrically powered equipment on the vessel, including hydraulic pumps. The topside modules on the stern hull section includes utility modules 124. The stern hull section also holds an access block 126 and a helicopter platform 130. A water ballast tank 132 is operated in conjunction with the water ballast tank 90 at the bow end.

Equipment on the midship hull section 24 includes a riser tensioning system 140 and piping and cabling systems 142, in addition to a moonpool 144. Such equipment is in addition to the cranes 60, derrick 64 and drilling support structure 62. As previously mentioned, the midship hull section 24 and the complicated and dangerous equipment installed on it, are best produced in a shipyard that is specialized for such hull and equipment and that has an excellent reputation for such drilling and production equipment.

Thus, the invention provides a method for constructing a very large vessel, and especially a hydrocarbon production vessel of at least 40,000 tons of steel weight, by constructing it so the slot of time required for a very large dry dock is a minimum, and so that the vessel and especially a section that contains drilling and riser connection equipment, is manufactured with high expertise. This is accomplished by constructing the vessel hull in a plurality of sections at different fabrication yards. Accordingly, the long period of time required for welding steel plates together to produce each hull section can occur in a dry dock of modest size. Afterwards, some and preferably all of the hull sections are moved to a very large dry dock where they are welded together in tandem. Topside modules are preferably each installed in the shipyard where that hull section is constructed. This is especially important for the hull section that contains drilling and riser connection equipment, since expertise is especially important for this section. Afterward, hydrocarbons are produced through the riser connection equipment on the midship hull section and stored in tanks on the bow and stern hull sections.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A method for at least constructing a very large hydrocarbon production vessel of at least 40,000 tons of steel weight which has a hull and equipment on the hull, the hull having a plurality of hull sections including bow and stern end sections and having a midship section for lying between the bow and stern sections, wherein one of the sections includes a riser coupling for connecting to a riser extending to a seafloor reservoir, and wherein said hull sections are each constructed by fastening together large steel plate sections, comprising:

constructing said midship hull section in a first fabrication yard, and constructing said bow and stern end sections in a least a second fabrication yard;

floating and moving along a body of water, at least one of said hull sections to a single assembly dry dock and fastening said plurality of hull sections together in tandem in said assembly dry dock;

said step of constructing including fastening plates across a first end of at least one of said hull sections that is floated and moved along a body of water to said assembly dry dock to keep out water, while establishing a second end of said one of said hull sections so it is water tight.

2. A method for at least constructing a very large hydrocarbon production vessel of at least 40,000 tons of steel weight which has a hull and equipment on the hull, the hull having a plurality of hull sections including bow and stern end sections and having a midship section for lying between the bow and stern sections, wherein one of the sections includes a riser coupling for connecting to a riser extending to a seafloor reservoir, and wherein said hull sections are each constructed by fastening together large steel plate sections, comprising:

constructing said midship hull section in a first fabrication yard, and constructing said bow and stern end sections in a least a second fabrication yard;

floating and moving along a body of water, at least one of said hull sections to a single assembly dry dock and fastening said plurality of hull sections together in tandem in said assembly dry dock;

said step of constructing including installing drilling and production equipment on said midship section, and installing hydrocarbon storage tanks each of a volume of a plurality of cubic meters on each of said hull end sections but not on said midship section.

3. A method for at least constructing a very large hydrocarbon production vessel of at least 40,000 tons of steel weight which has a hull and equipment on the hull, the hull having a plurality of hull sections including bow and stern end sections and having a midship section for lying between the bow and stern sections, wherein one of the sections includes a riser coupling for connecting to a riser extending to a seafloor reservoir, and wherein said hull sections are each constructed by fastening together large steel plate sections, comprising:

constructing said midship hull section, including installing drilling equipment on said midship hull section, in a first fabrication yard, and constructing said bow and stern end sections in a least a second fabrication yard;

floating and moving along a body of water, at least one of said hull sections to a single assembly dry dock and fastening said plurality of hull sections together in tandem in said assembly dry dock.

4. A method for at least constructing a very large hydrocarbon production vessel of at least 40,000 tons of steel weight which has a hull and equipment on the hull, the hull having a plurality of hull sections including bow and stern end sections and having a midship section for lying between the bow and stern sections, wherein one of the sections includes a riser coupling for connecting to a riser extending to a seafloor reservoir, and wherein said hull sections are each constructed by fastening together large steel plate sections, comprising:

constructing said midship hull section in a first fabrication yard, and constructing said bow and stern end sections in a least a second fabrication yard, including forming a plurality of ends of said hull sections with cofferdams to facilitate the joining of adjacent ends of two hull sections;

floating and moving along a body of water, at least one of said hull sections to a single assembly dry dock and fastening said plurality of hull sections together in tandem in said assembly dry dock.

5. A method for at least constructing a very large hydrocarbon production vessel of at least 40,000 tons of steel weight which has a hull and equipment on the hull, the hull having a plurality of hull sections including bow and stern end sections and having a midship section for lying between the bow and stern sections, wherein one of the sections includes a riser coupling for connecting to a riser extending to a seafloor reservoir, and wherein said hull sections are each constructed by fastening together large steel plate sections, comprising:

constructing said midship hull section in a first fabrication yard, and constructing said bow and stern end sections in a least a second fabrication yard, including forming a bow end of said stern end section with a cofferdam, to facilitate the joining of the stern and midship sections;

floating and moving along a body of water, at least one of said hull sections to a single assembly dry dock and fastening said plurality of hull sections together in tandem in said assembly dry dock.

6. A method for at least constructing a very large hydrocarbon production vessel of at least 40,000 tons of steel weight which has a hull and equipment on the hull, the hull having a plurality of hull sections including bow and stern end sections and having a midship section for lying between the bow and stern sections, wherein one of the sections includes a riser coupling for connecting to a riser extending to a seafloor reservoir, and wherein said hull sections are each constructed by fastening together large steel plate sections, comprising:

constructing said midship hull section in a first fabrication yard including fastening steel plates across both bow and stern ends of said midship section, and constructing said bow and stern end sections in a least a second fabrication yard;

floating and moving along a body of water, at least one of said hull sections to a single assembly dry dock and fastening said plurality of hull sections together in tandem in said assembly dry dock.

* * * * *